US007909708B2

(12) United States Patent
Gilbert

(10) Patent No.: US 7,909,708 B2
(45) **Date of Patent: *Mar. 22, 2011**

(54) GOLF CLUB HEAD

(75) Inventor: Peter J. Gilbert, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/568,032

(22) Filed: Sep. 28, 2009

(65) Prior Publication Data

US 2010/0029405 A1 Feb. 4, 2010

Related U.S. Application Data

(63) Continuation of application No. 12/128,939, filed on May 29, 2008, now Pat. No. 7,594,862, which is a continuation-in-part of application No. 11/475,920, filed on Jun. 28, 2006, which is a continuation-in-part of application No. 10/639,632, filed on Aug. 13, 2003, and a continuation-in-part of application No. 10/902,064, filed on Jul. 30, 2004, now Pat. No. 7,273,422.

(60) Provisional application No. 60/528,708, filed on Dec. 12, 2003.

(51) Int. Cl.
*A63B 53/04* (2006.01)

(52) U.S. Cl. ..... 473/330; 473/331; 473/342

(58) Field of Classification Search ..... 473/324–350, 473/282–292, 219–256; D21/747–752, 759
See application file for complete search history.

(56) References Cited

U.S. PATENT DOCUMENTS

| | | | | |
|---|---|---|---|---|
| 1,611,110 | A | 12/1926 | East | |
| 1,965,954 | A * | 7/1934 | Davis | 473/242 |
| 2,447,967 | A | 8/1948 | Stone | |
| 4,413,825 | A | 11/1983 | Sasse | |
| 4,529,203 | A | 7/1985 | Ribaudo | |
| 4,768,787 | A | 9/1988 | Shira | |
| 4,792,140 | A | 12/1988 | Yamaguchi et al. | |
| 4,801,146 | A | 1/1989 | Honma | |
| 4,869,508 | A | 9/1989 | Miller | |
| 4,964,641 | A * | 10/1990 | Miesch et al. | 473/330 |
| 4,992,236 | A | 2/1991 | Shira | |
| 5,100,144 | A | 3/1992 | Okumoto et al. | |
| 5,358,249 | A | 10/1994 | Mendralla | |

(Continued)

FOREIGN PATENT DOCUMENTS

JP 09-253250 * 9/1997

OTHER PUBLICATIONS

"Pelz Wedges . . . Technology for Scoring," 4 pages, www.pelzgolf.com, Sep. 29, 2006.

*Primary Examiner* — Sebastiano Passaniti
(74) *Attorney, Agent, or Firm* — Michael J. Mancuso

(57) ABSTRACT

A golf club head having a multi-material face. The golf club head has a hard, wear resistant material as the ball-impacting face surface coupled to a softer material, allowing the multi-material face to be joined to a soft body material such that the body can be bent and customized. The multi-material face allows for improved playing characteristics by allowing the club designer to use a thinner face and lighter body material while still providing improved face wear resistance and durability.

11 Claims, 11 Drawing Sheets

U.S. PATENT DOCUMENTS 5,437,088 A 8/1995 Igarashi
5,447,311 A 9/1995 Viollaz et al.
5,458,334 A 10/1995 Sheldon et al.
5,472,202 A 12/1995 Yamanaka
5,505,450 A 4/1996 Stuff
5,591,092 A 1/1997 Gilbert
5,620,382 A 4/1997 Cho et al.
5,637,044 A 6/1997 Swash
5,688,186 A 11/1997 Michaels et al.
5,774,970 A 7/1998 Huang
5,785,610 A * 7/1998 Birmingham ..... 473/331
5,807,190 A 9/1998 Krumme et al.
5,879,243 A 3/1999 Hackman
D410,053 S 5/1999 Wu
5,935,018 A 8/1999 Takeda
5,967,903 A 10/1999 Cheng
6,074,309 A 6/2000 Mahaffey
6,099,414 A 8/2000 Kusano et al.
6,200,229 B1 3/2001 Grace et al.
6,224,497 B1 5/2001 Antonious
6,309,310 B1 10/2001 Shira
6,319,437 B1 11/2001 Elsner et al.
6,346,052 B1 2/2002 Chappell
6,348,010 B1 2/2002 Doolen
6,348,011 B1 2/2002 Reyes et al.
6,398,665 B1 * 6/2002 Antonious ..... 473/330
6,402,636 B1 * 6/2002 Chang ..... 473/324
6,605,006 B2 8/2003 Mason
6,638,180 B2 10/2003 Tsurumaki
6,739,984 B1 5/2004 Ciasullo
6,814,673 B2 11/2004 Wahl et al.
D503,762 S * 4/2005 Wood ..... D21/759
D504,480 S * 4/2005 Nishitani et al. ..... D21/759
D505,467 S * 5/2005 Marr ..... D21/759
6,890,270 B2 5/2005 Ciasullo
7,014,568 B2 3/2006 Pelz
7,285,057 B2 10/2007 Mann, Jr. et al.
D570,934 S * 6/2008 Ban et al. ..... D21/744
D588,666 S * 3/2009 Takahashi ..... D21/759
7,594,862 B2 * 9/2009 Gilbert ..... 473/330
7,594,863 B2 * 9/2009 Ban ..... 473/331
7,695,377 B2 * 4/2010 Yamagishi et al. ..... 473/331
2002/0187851 A1 12/2002 Chang
2003/0119602 A1 * 6/2003 Kennedy et al. ..... 473/342
2003/0220157 A1 11/2003 Dennis et al.
2004/0053704 A1 3/2004 Gilbert
2005/0037859 A1 2/2005 Gilbert et al.
2006/0160634 A1 7/2006 Lee
2008/0125241 A1 * 5/2008 Tateno et al. ..... 473/331

* cited by examiner

GOLF CLUB HEAD

CROSS-REFERENCE TO RELATED APPLICATIONS

This is a continuation of U.S. patent application Ser. No. 12/128,939, filed May 29, 2008 now U.S. Pat. No. 7,594,862, which is a continuation-in-part of U.S. patent application Ser. No. 11/475,920, filed on Jun. 28, 2006, now pending, which is a continuation-in-part of U.S. patent application Ser. No. 10/639,632, filed Aug. 13, 2003, now pending, and a continuation-in-part of U.S. patent application Ser. No. 10/902,064, filed on Jul. 30, 2004, now U.S. Pat. No. 7,273,422, which claims the benefit of U.S. provisional patent application Ser. No. 60/528,708, filed on Dec. 12, 2003, the disclosures of which are incorporated herein by reference in their entireties.

FIELD OF THE INVENTION

The present invention relates to golf clubs. In particular, the present invention relates to a golf club head having an improved striking surface.

BACKGROUND OF THE INVENTION

Golf club heads come in many different forms and makes, such as wood- or metal-type, iron-type (including wedge-type club heads), utility- or specialty-type, and putter-type. Each of these styles has a prescribed function and make-up.

Iron-type and utility-type golf club heads generally include a front or striking face, a top line, and a sole. The front face interfaces with and strikes the golf ball. A plurality of grooves, sometimes referred to as "score lines," is provided on the face to assist in imparting spin to the ball. The top line is generally configured to have a particular look to the golfer and to provide structural rigidity for the striking face. A portion of the face may have an area with a different type of surface treatment that extends fractionally beyond the score line extents. Some club heads have the surface treatment wrap onto the top line. The sole of the golf club is particularly important to the golf shot because it contacts and interacts with the ground during the swing.

In conventional sets of iron-type golf clubs, each club includes a shaft with a club head attached to one end and a grip attached to the other end. The club head includes a face for striking a golf ball. The angle between the face and a vertical plane is called the loft angle.

The United States Golf Association (USGA) publishes and maintains the Rules of Golf, which govern golf in the United States. Appendix II to the USGA Rules provides several limitations for golf clubs. For example, the width of a groove cannot exceed 0.035 inch, the depth of a groove cannot exceed 0.020 inch, and the surface roughness within the area where impact is intended must not exceed that of decorative sand-blasting or of fine milling. The Royal and Ancient Golf Club of St. Andrews, which is the governing authority for the rules of golf outside of the United States, provides similar limitations to golf club design.

A set of golf clubs generally includes irons that are designated number 2 through number 9, and a pitching wedge. Other wedges, such as a lob wedge, a gap wedge, and a sand wedge, may be optionally included with the set. Utility irons, also known as hybrid clubs, may optionally replace one or more of the long irons, such as a 2-iron or 3-iron. Each iron has a shaft length that usually decreases through the set as the loft for each club head increases from the long irons to the short irons. The length of the shaft, along with the club head loft, moment of inertia, and center of gravity location, impart various performance characteristics to the ball's launch conditions upon impact and determine the distance the ball will travel. Flight distance generally increases with a decrease in loft angle. However, difficulty of use also increases with a decrease in loft angle.

Golf clubs are typically fabricated having standard values for lie angle, loft angle, face offset, etc. Individual golfers, however, typically require clubs having different dimensions than the standard values. To customize these clubs, the hosel portion, which is a socket in the club head into which the shaft is inserted, is typically bent to change the standard dimensions of the club head. This need for club manipulation requires that the club head be formed of a relatively soft, malleable material.

The club head face, which strikes the golf ball during use, typically has grooves formed therein. These grooves grip the golf ball and impart spin thereto. This spinning enhances the aerodynamic effect of the golf ball dimples, and allows a skilled golfer to control the flight profile of the ball while airborne and the behavior of the ball after landing. Normally through regular use, the golf club face, including the grooves, experiences significant wear. This wearing away, or erosion, of the club head face is exaggerated and promoted by the soft material required for club head customization, and results in the groove volume decreasing and the groove edges becoming rounded. Since groove design is critical for ensuring that proper spin is applied to the golf ball, changes in groove geometry result in degraded performance.

Past attempts to increase the imparted ball spin or to improve face wear have included adding a coating to the club face. These coatings preserve surface roughness as they wear away. However, the coatings do not reduce the material wear from the face surface. Some tend to wear away relatively quickly through normal use, leaving the club head material exposed. Once exposed, the club head face material wears away and performance is compromised. Other attempts to reduce wear have included forming the entire club head of a wear-resistant material, such as chrome plating. While these clubs are batter at resisting face wear, they have the undesirable effect of effectively preventing club customization, since wear-resistant materials tend to have very low ductility and malleability.

SUMMARY OF THE INVENTION

The present invention relates to golf clubs, and in particular to golf club heads having improved striking surfaces. The striking surface includes two dissimilar materials with substantially different material attributes and characteristics. For example, the materials may be of substantially different hardness. Inclusion of such varying materials on a single club face allows the golf club designer great freedom in selecting materials based on desired characteristics of the resulting golf club. However, such varying and dissimilar materials are not easily joined together. Welding, for instance, is not an option.

The present invention solves this problem by joining the dissimilar materials via explosion welding. This is a solid state joining process that allows dissimilar materials to be joined via a mechanical interlocking, at a molecular level, of the surfaces. The process involves accelerating one of the materials toward the other at an extremely high velocity through the use of explosives, resulting in a continuous surface joint between the components. Explosion welding allows the dissimilar materials to be joined together without using any additional components or devices.

One golf club head of the present invention includes a striking face formed of two dissimilar materials with substantially different hardnesses. The outer layer is soft to provide a good feel to the club. The outer layer is soft to provide a good feel to the club. The outer material layer defines a plurality of slots extending therethrough, and the inner material layer contains a plurality of protrusions corresponding to the slots. When mated, the protrusions pass through the slots to create a smooth ball-impact surface of the golf club. Grooves are formed in the protrusions, and are thus formed exclusively in the material of the inner layer. The inner layer is formed of a hard material, such that the grooves exhibit increased wear resistance. Thus, the striking face of the golf club includes a plurality of materials having substantially different physical and mechanical properties. So, the striking face may have varying wear resistance, with the wear resistance in and around the grooves being greater than the wear resistance at other portions of the striking face distal from the grooves. Alternatively, the grooves can be formed such that they overlap the junction between dissimilar materials.

In another golf club head of the present invention, no slots or protrusions are formed in the layers forming the club face. The face may be provided in the form of an insert that is attached to the club head body. If the softer material is chosen to be the same as or similar to the material of the club body, the multi-material face can be welded—via the softer of the face materials—to the club head body. This design allows for a club head having a readily adjustable and customizable body, while also providing increased face wear resistance and ensuring the dissimilar materials will not become separated from each other.

BRIEF DESCRIPTION OF THE DRAWINGS

The present invention is described with reference to the accompanying drawings, in which like reference characters reference like elements, and wherein.

DETAILED DESCRIPTION OF THE PREFERRED EMBODIMENTS

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
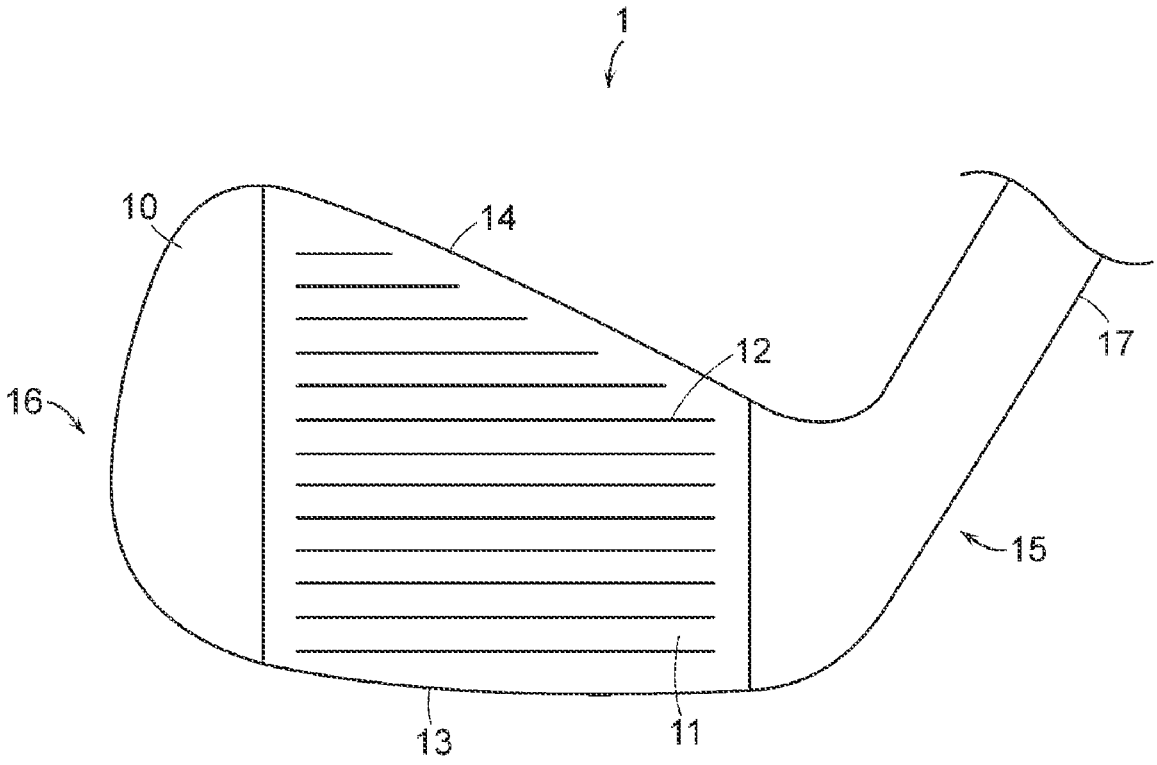
FIG. 1 shows a golf club head of the present invention.

The present invention is directed to a golf club head with an improved striking surface. FIG. 1 shows a golf club head 1 of the present invention. The golf club head 1 includes a body 10 defining a front surface 11, a sole 13, a top line 14, a heel 15, a toe 16, and a hosel 17. The striking face of the front surface 11, which contains grooves 12 therein, and the sole 13 may be unitary with the body 10, or they may be separate bodies, such as inserts, coupled thereto. While the club head 1 is illustrated as an iron-type golf club head, the present invention may also pertain to a utility-type golf club head or a wood-type club head.

Figure 2:
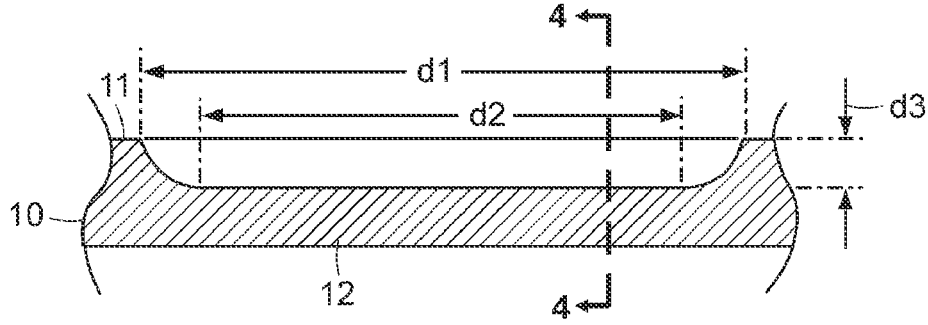
FIG. 2 shows a cross-sectional view of a club head of the present invention along a groove.

FIG. 2 shows a cross-sectional view of the club head 1 along a groove 12. Grooves 12 are machined into the surface of the striking face 11, which allows the draft angle to be decreased. Grooves 12 extend from a toe end of the club head 1 to a heel end of the club head 1. The grooves 12 are shallow at both the toe and heel portions of the club head 1, and are deep in the central regions. Grooves 12 have a first distance $d_1$ measured along the surface of striking face 11 and a second distance $d_2$ measured along the deepest portion of the grooves, which have a depth $d_3$. Thus, first distance $d_1$ is an overall distance and second distance $d_2$ is a maximum depth distance. Preferably, the groove depth along the maximum depth distance $d_2$ is substantially constant. In one embodiment the maximum depth distance $d_2$ is at least 0.25 inch shorter than the overall distance $d_1$. The groove draft angle $\alpha$ ranges from about 0.5° to 12°, more preferably about from 4° to 6°, and most preferably 5°.

Figure 3:
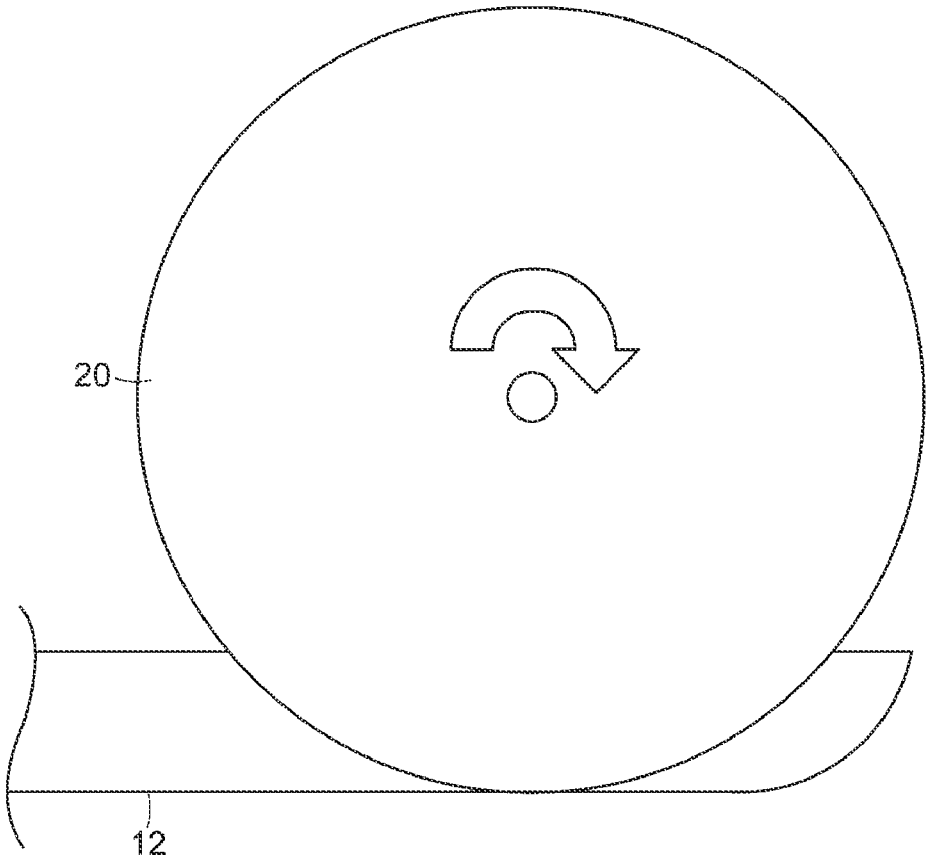
FIG. 3 shows a preferred groove cutting setup.

Grooves 12 are radiused at the toe and heel portions of the club head 1, and are about 0.02 inch deep at a geometric center of the face 11. Grooves 12 are machined into the strike face surface 11. The club head 1 is retained in a mold, which preferably is formed of a material soft enough to not damage the club head 1 yet resilient enough to firmly retain the golf club head 1, and a cutter, preferably a round cutter or a saw cutter, is used to form the grooves 12. As shown, the toe and heel portions are radiused about an axis of rotation that is perpendicular to a longitudinal axis of the groove. Furthermore, that axis of rotation is approximately parallel to face 11 of club head 1. Preferred cutters have a diameter from ⅜ inch to ¾ inch. A preferred range of groove radii include from 0.125 inch to 5 inches, with 0.25 inch to 2.5 inches being more preferred. Having radiused grooves 12 facilitates removal of dirt, grass, sand, and other materials that typically become embedded within the grooves of a golf club during normal use by eliminating corners that can trap these materials. FIG. 3 shows a preferred groove cutting setup illustrating cutter 20 with groove 12.

Figure 4:
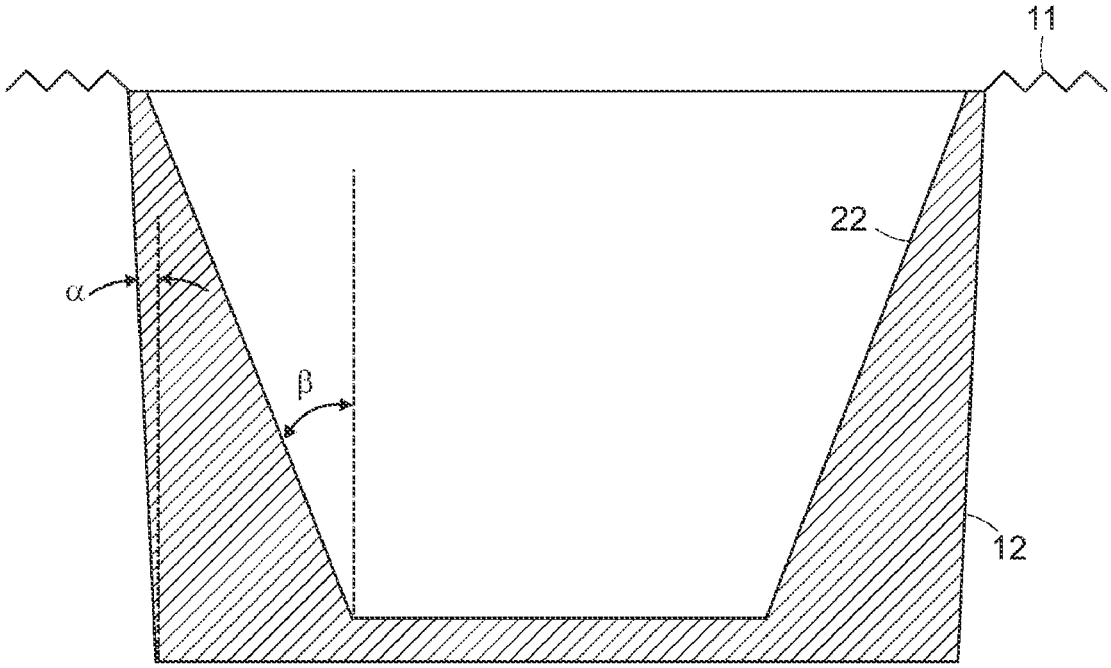
FIG. 4 shows a comparison of a groove of the golf club head of FIG. 1 as viewed along lines 4-4 of FIG. 2 with a known groove.

Machining the grooves 12, in addition to decreasing the draft angle, increases the rate of production and allows for tighter tolerances than casting or forging. The rate of production is increased by decreasing the number of required manufacturing steps. Instead of inserting the tool into the club face, machining the grooves, and removing the tool from the club face in three separate steps, as required by known groove creating processes, the present invention allows all three to be combined into one step. This is possible because the turning axis of the present cutter is parallel to the face, rather than the perpendicular axes of known processes. The tighter tolerances possible with the present invention allow less material to be removed, also decreasing manufacturing time. FIG. 4 shows a comparison of a groove 12 of the present invention with a typical groove 22 of known golf club heads. The groove 12 preferably has a depth of 0.02 inch, which is the USGA limit. Due to loose tolerances, known grooves 22 were designed well short of this limit. Similarly, known manufacturing processes required a large draft angle $\beta$, typically around 16°. The draft angle $\alpha$ of grooves 12 is much smaller, increasing the cross-sectional area of the groove and groove volume for a given length.

As noted above, the governing bodies of golf place limitations of the geometry of grooves 12. The increased tolerance control afforded by machining the grooves 12 of the present invention allows the actual groove geometry to be closer to the limits than was previously achievable. Thus, the grooves 12 of the present invention maximize groove volume, enhancing the groove performance during use. With the improved grooves of the present invention, the grooves better grip the ball, allowing a golfer to apply more spin to the ball. The golfer's control over the ball, both during ball flight and subsequent to flight, such as when landing and settling on a golf green, are increased. The grooves 12 of the present invention also result in a golf club head that is more aesthetically pleasing and that allows better ball control.

Figure 5:
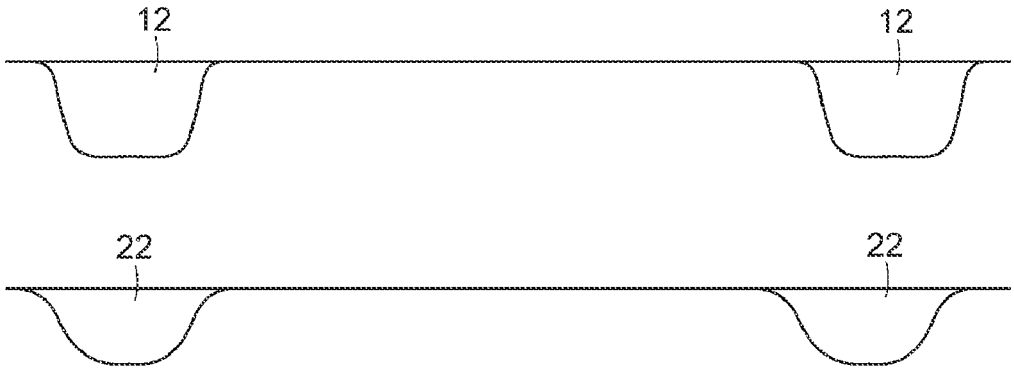
FIG. 5 shows a comparison of a groove of the golf club of FIG. 1 and a known groove.

FIG. 5 shows a comparison of a groove 12 of the present invention with a typical groove 22 of known golf club heads. The known grooves 22 are quite rounded. The grooves 12 of the present invention, however, are much sharper. The edges are more defined, the depth is greater, and the dimensions are more consistent and closer to the limits. All of these factors allow the golf club head 1 to better grip the golf ball, increasing the user's control over the ball.

The face 11 of the club head 1 of the present invention is also enhanced to provide additional ball control and enhanced performance. The strike surface 11 is provided with a roughened texture. A common measure of roughness in surface finish is average roughness, Ra. Ra, also known as Arithmetic Average (AA) and Center Line Average (CLA), is a measure of the distance from the peaks and valleys to the center line or mean. It is calculated as the integral of the absolute value of the roughness profile height over the evaluation length:

$$Ra = \frac{1}{L}\int_0^L |r(x)|\,dx$$

The face 11 is roughened by machining, preferably with a Computer Numerically Controlled (CNC) mill. Known golf clubs have a face roughness at most 40 Ra. At least a portion of the face 11 in the proximity of the grooves, and more preferably the entire face 11, is machined such that it has a substantially uniform textured surface with a roughness greater than 40 Ra. Preferably, the roughness is from 75 Ra to 300 Ra, more preferably from 100 Ra to 200 Ra, and most preferably from 120 Ra to 180 Ra.

Providing a textured strike face allows the golfer to apply more friction to the ball during use, allowing the golfer to put more spin on the ball and have greater control of the ball. Conventionally, golfers have to take a full swing to induce enough golf ball spin to control the ball movement on a golf green. With the golf club head of the present invention, a golfer can induce golf ball spin in "partial" shots, or shots when the golfer is not taking a full swing. The textured strike surface of the present invention also distributes the shear force resulting from the golf swing over a greater area of the golf ball. This reduces cover damage and extends golf ball life.

The golf club head 1 preferably is formed of a soft base metal, such as a soft carbon steel, 8620 carbon steel being an example. A chrome finish may be applied to the base metal to inhibit wear and corrosion of the base metal. If included, the chrome finish preferably includes a non-glare layer. The chrome finish layer preferably has a thickness between 0.005 μin and 280 μin, with 80 μin a preferred thickness. A nickel finish may additionally be applied to the base metal as a sub-layer for chrome or another finish layer or may alternatively be applied to the base metal as the finish layer. If included, the nickel finish preferably has a thickness between 400 μin and 1200 μin, with 800 μin a preferred thickness. In addition, or as an alternative to the finish materials described above, the club head may be plated with any plating material, such as black nickel. Additionally it should be appreciated that the plating material may be applied using any technique such as submerging the parts in one or more plating baths or using physical or chemical vapor deposition.

In use, the grooves 12 and strike face 11 of the present invention enhance performance, especially in adverse conditions. The higher friction possible with the golf club head 1 allows a tighter grip on the golf ball during "wet" or "grassy" conditions than was previously possible. The club head of the present invention was tested, and as shown in Table 1 below, the generated revolutions per minute of a struck golf ball were substantially the same as those generated with a conventional club for a full dry shot, but were increased in a half dry shot and in both a full wet shot and a half wet shot. The "dry" shots contained substantially no moisture on the club face and ball. For the "wet" shots, the club face and/or the golf ball surface were sprayed with water in an amount that would be typical for shots made during a round in dewy or rainy conditions. A 60° wedge was used in these tests. Table 1 shows the revolutions per minute of a golf ball after being struck with a standard club or a spin milled club of the present invention, and illustrates the benefit of the spin milled grooves over standard grooves.

TABLE 1

| Shot Conditions | Standard | Spin Milled |
|---|---|---|
| Dry - full | 12250 | 12000 |
| Dry - half | 6500 | 7750 |
| Wet - full | 8000 | 12000 |
| Wet - half | 4000 | 8000 |

A preferred method of making the club head 1 includes first making a club head body. This may be done by casting, forging, or any other manufacturing method. The face is then machined such that it is substantially smooth and flat, preferably flat within ±0.002 inch. This preferably may be done by fly-cutting the face, which is cutting with a single-point tool fixed to the end of an arm protruding from a vertical milling shaft. Having a flat face allows the golfer to achieve consistent results during use. The body preferably is nested during the face flattening process. That is, the body is retained within a housing such that it is substantially immobile. The face is left exposed so that it can be worked on. The housing may be padded or otherwise designed such that it does not damage the club head.

Once the requisite face flatness has been achieved, the grooves are created and the surface is roughened as described above. While it is preferred that the grooves be spin milled prior to roughening the surface, the order of these steps is not essential. In fact, it is possible that they be performed substantially simultaneously, or with at least some amount of overlap.

The spin milled grooves may have very sharp edges, which could have an adverse effect on a golf ball during use. Thus, the grooves may be deburred to remove any sharp edges in the groove-to-face junction. This creates a radius at the junction, the radius preferably being less than 0.01 inch. This deburring can be carried out in a variety of ways. The junction may be filed, such as with a wire brush or a file, such as a carbide file. In conjunction with filing, or as an alternative method, the junction can be deburred by blasting. This may include impacting small beads at the junction at high speeds. To protect the face of the club head, which may have already been roughened above 40 Ra, the face may be masked. Masking includes placing a physical barrier on the face adjacent the grooves such that the projected particles cannot impact the face. Alternatively or in conjunction with masking, a nozzle can be used to accurately direct the projected material only at the junction.

While golf club heads are typically manufactured having standard values for loft angle, lie angle, offset, and other dimensions, individual golfers often require modification of the club heads to suit their particular swing. For example, a golfer's swing may require his clubs to have a lie angle 2° greater than the standard value. To obtain the club dimensions required for an individual golfer, club head 1 is customized by altering the standard dimensions. This typically entails locking club head 1 in a vise or like device and bending the hosel 17 to obtain the desired values for loft angle, lie angle, offset, etc. To facilitate this manipulation, the club head 1 is formed of a first, relatively soft and malleable material.

The front surface or strike face 11 is used to contact golf balls during normal use. The strike face 11 includes grooves 1, which grip the golf ball and impart spin thereto. This spinning enhances the aerodynamic effect of the golf ball dimples, and allows a skilled golfer to control the flight profile of the ball while airborne and the behavior of the ball after landing. Repeated contacts of the strike face 11 through routine use cause it and the grooves 12 to wear away. To delay the wearing away of the strike face 11 and to help ensure that the geometry of the grooves 12 remains unaltered, the strike face 11 is formed of a second material that resists wear. If a material is wear-resistant, it tends to be less ductile. Since ductility is desired for the material forming the body 10, the strike face 11 preferably is an insert that is coupled to body 10. The first material is a relatively soft, ductile material, and may be a material typically used to form golf clubs. Iron-type golf clubs are typically manufactured from carbon steel or a relatively soft stainless steel. Preferred carbon steels include 1025, 8620, and S20C, and preferred stainless steels include 431, 303, and 329. Forming body 10 of one of these materials allows for customization of club head 1 to obtain the required dimensions for a user's individual swing. These materials typically have an elongation of approximately 13% or more, and preferably within the range of approximately 15% to approximately 21%, when tested according to usual standards.

The second material is a wear-resistant material. A convenient method of categorizing and ranking material wear resistance is through ASTM G65, which is entitled "Standard Test Method for Measuring Abrasion Using the Dry Sand/Rubber Wheel Apparatus." Procedure A, which is relatively severe test for metallic materials, is the preferred procedure. This test characterizes materials in terms of weight loss under a controlled set of laboratory conditions. A material sample is held against a rubber wheel under a specified force. While the sample is pressed against the wheel, the wheel is rotated at a specified rate of rotation and aggregate material is introduced at a specified flow rate at the wheel-sample contact area. After a specified time has elapsed, the sample is withdrawn and measured to determine the volume loss. Test results are reported as volume loss in cubic millimeters. Materials of higher abrasion or wear resistance number indicates better wear resistance. Typical carbon steel golf clubs have a wear resistance of about 80. The second material of the present invention preferably has a wear resistance of 40 or less, and more preferably has a wear resistance of 35 or less.

Figure 6:
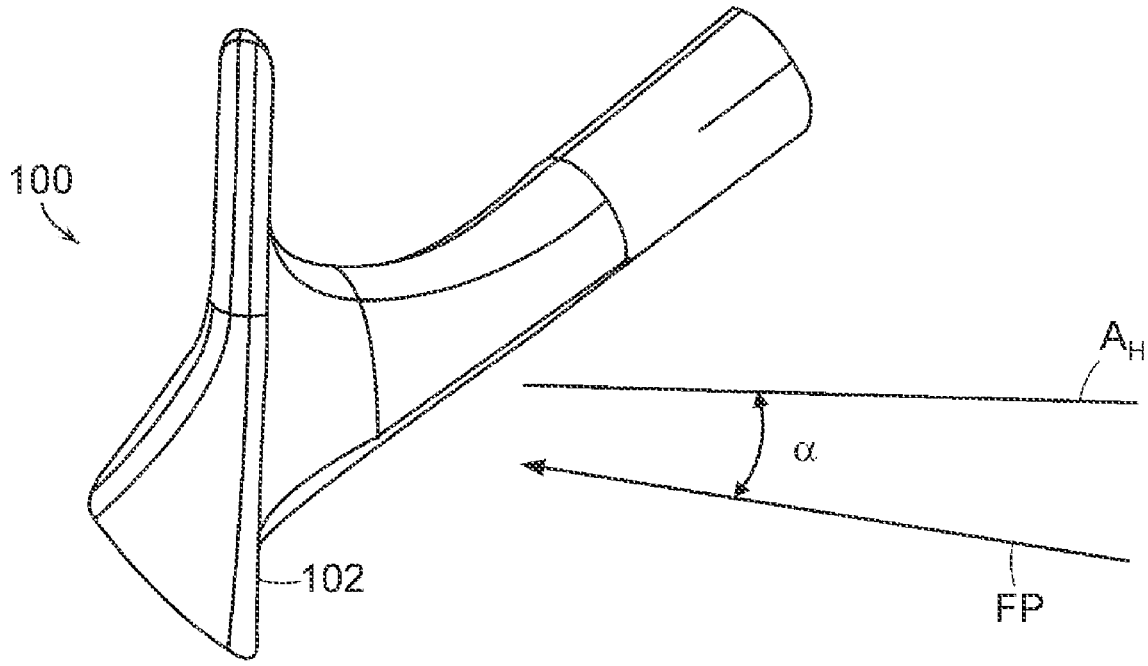
FIG. 6 illustrates a blast test configuration.

During development of the present invention, several clubs were subjected to blast testing. FIG. 6 illustrates the blast test configuration. A club head 100 was positioned and held in place with its face 102 being substantially vertical, or substantially perpendicular to a horizontal axis AH. Aggregate material was impacted against face 102 along a flow path FP at an angle $\alpha$ relative to horizontal axis $A_H$. A Zero model Pulsar III blast cabinet from Clemco Industries of Washington, Mo. was used for the tests. The machine was operated according to standard operating procedures using a quarter inch nozzle and an aggregate feed rate of 3.12 cubic feet per hour. Silica glass beads were used as the aggregate, and the blast pressure was 60 psi. The blast angle $\alpha$ was 20°, making 70° angle of impact relative to face 102. The duration of the blast tests was 40 minutes. The groove width prior to and after blasting was measured.

Figure 7:
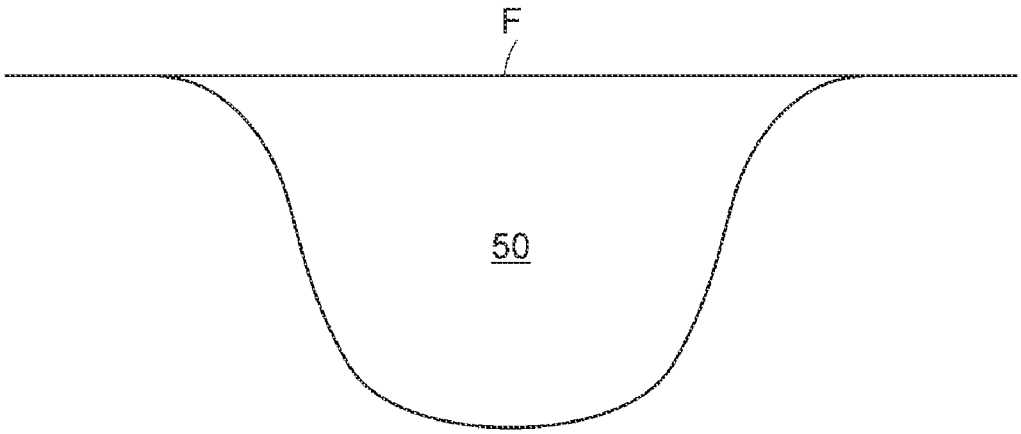
PRIOR ART FIG. 7
FIG. 7 shows a side view of a groove of a known golf club before blast testing.
Figure 8:
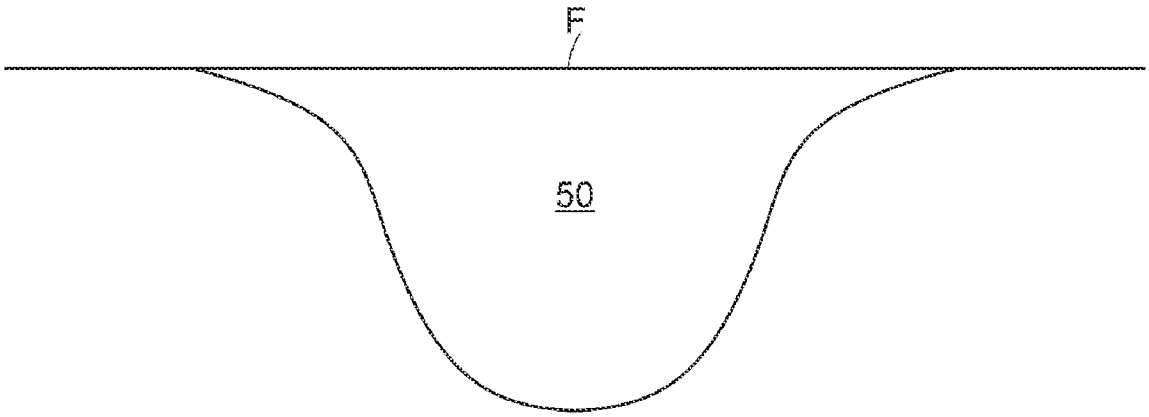
PRIOR ART FIG. 8
FIG. 8 shows the groove of FIG. 7 after blast testing.

The first club tested was a Vokey wedge with a raw finish. The Vokey wedge is formed from an 8620 carbon steel without a protective chrome finish. Drawing figures showing pre-blast and post-blast groove profiles for the Vokey wedge are provided for illustrative purposes. FIG. 7 shows a side view of a groove 50 of a Vokey wedge prior to blast testing. The image has been magnified 80 times. Groove 50 has uniform dimensions and is generally U-shaped. A line F corresponding to the plane of the club face is shown for illustrative purposes. The width of groove 50 is 0.045". FIG. 8 shows a side view of groove 50 of the Vokey wedge after blast testing. Groove 50 has been enlarged considerably, especially at the groove-face transition, which is the portion of a groove that contacts and grips a golf ball during use. Groove 50 has a post-blast width of 0.082", an 82.2% increase.

The second club tested was a Vokey wedge with a chrome finish. This club had a pre-blast groove width of 0.051" and a post-blast groove width of 0.076", a 49.0% change.

The third club tested was a Ping wedge. The Ping wedge is formed from a typical 17-4PH stainless steel. This club had a pre-blast groove width of 0.049" and a post-blast groove width of 0.072", a 56.9% change.

The final club tested was a wedge of the present invention. This club had a pre-blast groove width of 0.030" and a post-blast groove width of 0.036", a 20.0% change.

These results are summarized in Table 2 below:

TABLE 2

| Club | Pre-blast width (in.) | Post-blast width (in.) | Percent change |
|---|---|---|---|
| Vokey wedge - raw finish | 0.045 | 0.082 | 82.2% |
| Vokey wedge - chrome finish | 0.051 | 0.076 | 49.0% |
| Ping wedge | 0.049 | 0.072 | 56.9% |
| Present invention | 0.030 | 0.036 | 20.0% |

The grooves 12 of club head 1 of the present invention preferably have a change in width of less than approximately 40% upon blast testing. More preferably, the grooves 12 have a change in width of less than approximately 30% upon blast testing. Still more preferably, the grooves 12 have a change in width of less than approximately 25% upon blast testing.

During development of the present invention, a correlation between wear resistance and material hardness was discovered. A preferred material for the second material is disclosed in U.S. Pat. No. 5,370,750 to Novotny et al., which is incorporated herein by reference in its entirety. Novotny discloses a material exhibiting a preferred combination of hardness and corrosion resistance.

Novotny discloses that its unique hardness and corrosion resistance result predominantly from its controlled proportions of carbon and chromium. Carbon contributes to the high hardness, so at least about 1.40%, and more preferably at least 1.50%, carbon is present. Too much carbon adversely affects the corrosion resistance, so not more than about 1.75%, preferably not more than about 1.65%, carbon is present. For best results, the material contains about 1.58%-1.63% carbon. At least about 13.5%, preferably at least about 15.5%, chromium is present to benefit the corrosion resistance. Too much chromium adversely affects the hardness and restricts the solution treatment temperature to an undesirably narrow range, so not more than about 18.0%, preferably not more than about 16.5%, chromium is present. A summary of the preferred face composition is provided in Table 3, which was copied from table 1 of the Novotny reference.

TABLE 3

| Element | Broad range (%) | Preferred range (%) |
|---|---|---|
| C | 1.40-1.75 | 1.50-1.65 |
| Mn | 0.30-1.0 | 0.45-0.60 |
| Si | 0.80 max | 0.30-0.45 |
| P | 0.020 max | 0.020 max |

TABLE 3-continued

| Element | Broad range (%) | Preferred range (%) |
|---|---|---|
| S | 0.015 max | 0.015 max |
| Cr | 13.5-18.0 | 15.5-16.5 |
| Ni | 0.15-0.65 | 0.25-0.45 |
| Mo | 0.40-1.50 | 0.75-0.90 |
| V | 1.0 max | 0.40-0.50 |
| N | 0.02-0.08 | 0.04-0.06 |

The balance of the alloy is essentially iron, apart from the usual impurities.

Thus, the second material preferably includes approximately 1.40% to approximately 1.75% carbon and approximately 10.0% to approximately 18.0% chromium. More preferably, the second material includes approximately 1.50% to approximately 1.65% carbon and approximately 15.5% to approximately 16.5% chromium.

The carbon and chromium composition may also be expressed as a ratio. Per Novotny, the second material preferably comprises a ratio. Per Novotny, the second material preferably comprises a ratio of percentage chromium to percentage carbon from approximately 10:1 to approximately 11:1. All percentages discussed herein are weight percentages.

As stated above, wear resistance has a correlation to material hardness. Thus, another way to categorize the first and second materials is by their absolute and relative hardnesses. The first material is harder than the second material. This relationship provides the needed face wear resistance while allowing club head customization to accommodate a golfer's unique swing. This relationship is opposite from most clubs with face inserts, which provide a softer face and a harder body.

Through testing, it was determined that a second material having a Rockwell C hardness of about 40 or greater would provide adequate face wear resistance. More preferably, face insert 20 has a Rockwell C hardness of about 50 to about 55. To allow for workability, the first material preferably has a Rockwell C hardness of about 30 or less.

Because the sole 13 impacts the ground during normal use, it also experiences wear. Club head 1 may preferably include a sole 13 in the form of a sole insert comprised of a third material. The third material is harder than the first material. The third material exhibits similar wear resistant properties and compositions as discussed above with respect to the second material. The third material may be substantially the same as the second material, or it may be different.

Because the materials used to create the face of the golf club heads 1 of the present invention are dissimilar, having substantially different hardnesses, they are not readily joined together by welding. Known methods of joining dissimilar metals include adhering, brazing, mechanically fastening, and folding. These methods, however, require the presence of additional materials and/or do not result in uniform connection between the two metallic materials. For example, mechanical fasteners add unwanted bulk and connect the materials at only a limited number of locations. Folding, also called crimping, involves deforming an edge portion of one material over the perimeter of the second material, and thus similarly connects only the edges of the materials. Moreover, both mechanically fastening and folding require careful attention to ensure a uniform connection pressure among the limited number of connection points. For example, if the mechanical fasteners are not engaged in a careful manner, a first of such fasteners may apply greater connecting pressure than a second of such fasteners. This could result in non-uniform performance characteristics of the resulting golf club. Furthermore, introducing a third, connecting material, such as an adhesive, between the metallic materials may also change the performance characteristics of the resulting work piece, and may also break down over time resulting in non-uniform performance and/or catastrophic failure.

Figure 16:
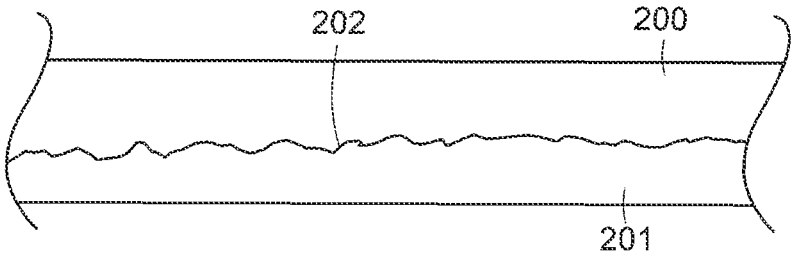
FIG. 16 a detail of an exemplary explosion welded connection.

A preferred method of attaching the dissimilar metallic materials uniformly couples the materials to each other without the presence of any third materials. That is, the materials are connected directly to each other without any intermediate material between the metallic materials being joined. Explosion welding is such a method. "Explosion welding" is a solid state process that allows dissimilar materials to be joined via a mechanical interlocking, at a molecular level, of the surfaces. The process involves accelerating one of the materials toward the other at an extremely high velocity through the use of explosives, resulting in a continuous surface joint between the components. An explosion welding connection is typically stronger than connections achievable via adhesives. While not to scale, FIG. 16 shows a portion of an exemplary explosion welding connection between dissimilar materials. Two layers, 200 and 201, respectively, of dissimilar materials are coupled directly together via an explosion weld junction 202. Due to strategic placement and detonation of the explosives, known to those skilled in that art, the two dissimilar material layers 200, 201 are permanently joined along the entirety of their mating surfaces, thus forming a uniform connection joint between the two dissimilar materials. Explosion welding allows the materials to be joined together via a cold-working process, allowing them to be joined without losing their pre-bonded properties. Sometimes an intermediate layer, for example a layer made of copper or a copper alloy, is included between the layers of dissimilar materials. Such an intermediate layer may be included to allow the metals to obtain more "bite" into the adjoining material layers.

The act of explosion welding may be carried out by placing one of the dissimilar materials, in sheet form, atop a dense, immovable surface. The second of the dissimilar materials, again in sheet form, is placed atop the first material. An artisan skilled in explosion welding then strategically positions a plurality of explosive charges atop the second material sheet. After positioning the explosives in the desired locations, the artisan detonates the explosives in a controlled, strategic manner, accelerating the second material to the first material and permanently joining the sheets together. The artisan determines the size and number of explosives used, the positioning of the explosives, and the order and relative timing of their detonations based on the properties of the materials being joined, the intended use of the resulting bi-material sheet, and other considerations. Once joined, the material can be used in a variety of manners. For example, blanks can be cut or punched from the bi-material sheet, the blanks being subjected to further machining processes to eventually become the face of a golf club head.

Figure 17:
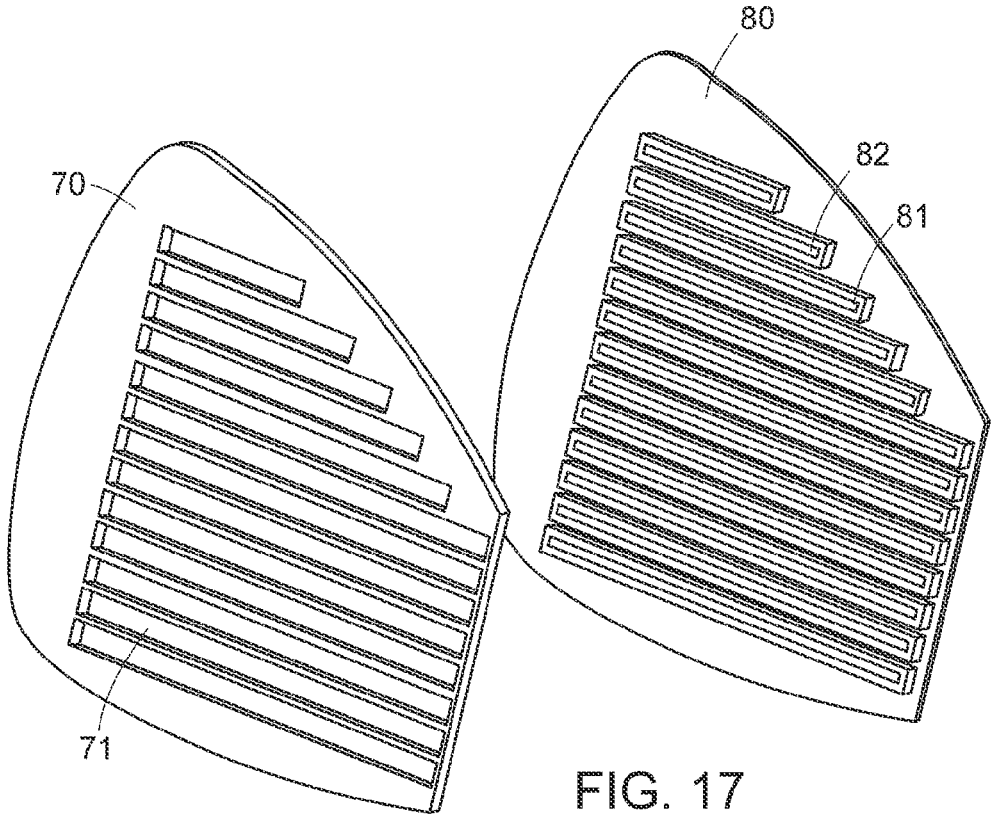
FIG. 17 shows an exploded view of two layers of dissimilar materials used to cooperatively form a striking face of a golf club head.
Figure 18:
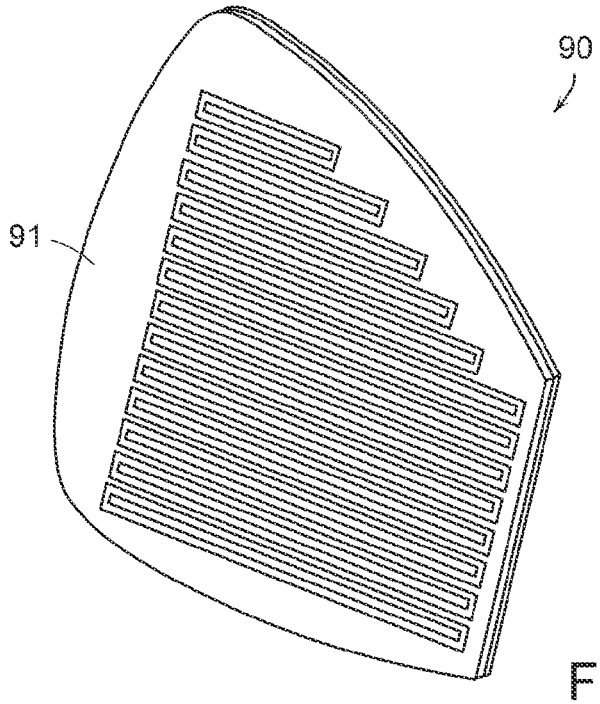
FIG. 18 shows the assembled striking face formed of the layers of FIG. 17.

FIG. 17 shows two layers of dissimilar materials, an outer layer 70 and an inner layer 80. The outer layer 70 defines a plurality of slots 71 passing through the outer layer 70. The inner layer 80 contains a plurality of protrusions 81. A groove 82 has been formed, such as via the machining processes discussed above, in each protrusion 81. When the outer and inner layers 70, 80 are aligned, the protrusions 81 matingly correspond to the slots 71. As shown in FIG. 18, when the outer and inner layers 70, 80 are coupled, the outer surface of the outer layer 70 and the outer surface of the protrusions 81 cooperatively form a striking face 91 of a golf club head. Thus, it is seen that in the assembled face 90 of the club head, the grooves 82 are formed exclusively in the material of the inner layer 80; the grooves 82 are not defined in any part by the material of the outer layer 70. Likewise, the material immediately surrounding the grooves 82 is formed exclusively of the material of the inner layer 80. The material of the outer layer 70 forms portions of the striking face 91 distal from the grooves 82.

Preferably, the materials of the outer and inner layers 70, 80 are dissimilar and are coupled directly together via explosion welding such that no other materials or components are used to form the connection. In other words, the outer and inner layers 70, 80 are coupled directly together without any intermediate material between the layers 70, 80, and without the use of any additional coupling elements, such as mechanical fasteners. The result is a multi-material face 90 with both materials present on the outer, impact surface 91 of the face 90. Alternate methods of attachment, such as through use of an adhesive or crimping, may also be used.

In a preferred embodiment, the outer layer 70 is formed of a relatively soft material while the inner layer 80 is formed of a relatively hard material. Thus, the majority of the striking face 91 is formed of a soft material, but the grooves 82 and the material immediately surrounding the grooves 82 is harder and therefore more wear resistant. Thus, the striking face 91 has varying wear resistance, where the wear resistance in and around the grooves 82 is greater than the wear resistance at other portions of the striking face 91 distal from the grooves 82. In use, the golfer thus achieves a soft feel when striking the golf ball while also realizing the benefits of increased wear resistance in and around the grooves 82, allowing the golfer to obtain more beneficial results more consistently and for a longer period of time than previously achievable.

Preferably, the hardnesses of the layers 70, 80 are substantially different. The use of an explosion welding connection allows these dissimilar materials to be connected to each other over a substantial portion, if not the entirety, of the mating surfaces. Preferred materials for the outer layer 70 include 8620 or other stainless steel, beryllium copper, or the like. Additional preferred materials for the outer layer 70 include powder metallurgy stainless steel, carburized stainless steel, precipitation hardenable stainless steel, precipitation hardenable super alloy, and cold worked stainless steel. Preferred materials for the inner layer 80 include maraging steel or alloys exhibiting similar properties. Additional preferred materials for the inner layer 80 include low alloy steel and austenitic stainless steel. Characterized differently, the material of the outer layer 70 preferably has a hardness range of approximately 20 Rockwell C to approximately 100 Rockwell C, and the material of the inner layer 80 preferably has a hardness range of approximately 50 Rockwell B to approximately 100 Rockwell B.

Preferred materials for the outer layer 70 are provided in Table 4-1 below, and preferred materials for the inner layer 80 are provided in Table 4-2 below:

TABLE 4-1

| Alloy | Alloy type | Final Hardness |
|---|---|---|
| 8620 | Low alloy steel | 89 HRb |
| 304L | Austenitic SSt | 85 HRb |
| 15-15 LC | Ni Strengthened Austenitic SSt | 89 HRb |
| 204 Cu | Cu Containing Ni Strengthened Austenitic SSt | 90 HRb |
| Gall-Tough | Austenitic SSt | 93 HRb |

TABLE 4-2

| Alloy | Alloy type | Final Hardness |
|---|---|---|
| Borated 304L SSt | Power Metallurgy Borated Austenitic SSt | 24 HRc |
| Pyrowear 675 | Carburizable SSt | 60 HRc Surface, 34 HRc Core |
| 440XH | Powder Metallurgy Martensitic SSt | 62 HRc |
| 440XH Mod | Powder Metallurgy Martensitic SSt | 58 HRc |
| Custom 475 Fully Hardened | Precipitation Hardenable SSt | 53 HRc |
| Custom 465 Fully Hardened | Precipitation Hardenable SSt | 50 HRc |
| Custom 465 Overaged | Precipitation Hardenable SSt | 36 HRc |
| Thermo-Span | Precipitation Hardenable Super Alloy | 38 HRc |
| Gall-Tough | Cold Worked Austenitic SSt | 40 HRc |

In an alternate design, the outer layer 70 is formed of a harder material than the inner layer 80. In this setup, the area of the striking face 91 around the grooves 82 is softer than the portions of the face 91 distal from the grooves 82. Therefore, the material in and around the grooves 82 wears more quickly than the other portions of the face 91 distal from the grooves 82.

In yet another design, the layers 70, 80 are mated before the grooves 82 are formed. In this embodiment, after the layers 70, 80 have been interlocked, the grooves 82 are formed such that the harder material forms one portion of the groove 82 and the softer material forms another portion of the groove 82. For example, the grooves 82 could be formed such that the material of the inner layer 80 forms the top portion of the groove 82 and the material of the outer layer 70 forms the lower portion of the groove 82. The grooves 82 may be formed, for example, by the spin milling process described above.

Figure 9:
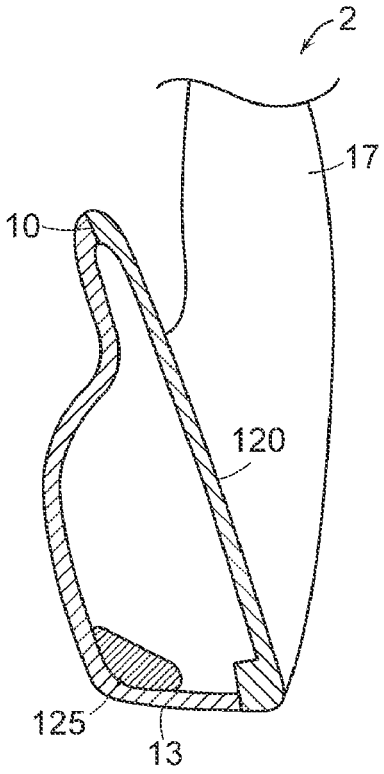
FIG. 9 shows a partial cross-sectional view of a golf club head of the present invention.
Figure 10:
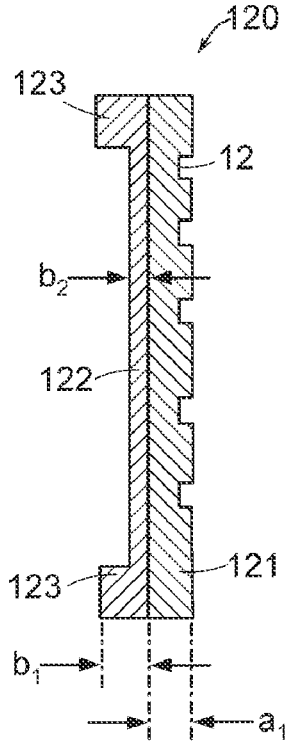
FIG. 10 shows a cross-sectional view through the face of the golf club head of FIG. 9.

FIG. 9 shows a partially cross-sectional view of a golf club head 2 of the present invention. This golf club head 2 is illustrated as being a hybrid- or utility-type club head. The club head 2 includes a face 120, which is illustrated in cross-sectional view in FIG. 10. The face 120 includes an outer layer 121 and an inner layer 122 formed of dissimilar materials coupled together via explosion welding. Explosion welding allows the outer layer 121, which includes the ball-striking surface, to be formed of a robust material such as a titanium alloy and the inner layer 122 to be formed of a lighter, malleable material such as a stainless steel alloy. Prior titanium faces joined to the club head body via welding required the body to also be formed of titanium, which bodies cannot be bent to a significant degree and for which grinding to a desired swing weight is not readily achievable. Attachment of a titanium face to a stainless steel body via deforming the body also has ill effects—a more rugged stainless steel is typically used, limiting its malleability, and the framed/supporting region is too large to achieve desirable coefficient of restitution or acoustics. The inner layer 122 may be provided with tangs or a peripheral ridge 123 that can be used to couple the face 120 to rest of the club head body 10. If the body 10 is formed of a comparable material as the inner layer 122, such as the same or a similar stainless steel alloy, the face 120 can be welded to the body 10. Thus, the inner layer 122, save the tangs/ridge 123, could be machined away such that the outer layer 121 is the only material present over a majority of the face 120. Other attachment means may also be used to couple the body 10 and face 120.

The use of stainless steel for the club head body 10 not only allows the manufacturer or golf professional to manipulate properties, such as lie and loft angles, of the club head, but also may reduce the weight of the club head. This weight savings allows the use of one or more weight members 125 through which the golf club designer can beneficially enhance certain characteristics of the club head and resulting golf club. For example, the weight and mass savings and weight member 125 can be used to increase the overall size of the club head, expand the sweet spot, enhance the moment of inertia, and/or optimize the club head center of gravity location. The inclusion of weight member 125 can, for example, lower and move afterward the club head center of gravity, creating a higher ball trajectory. Weight members 125 can also be positioned in the toe and heel regions of the club head, making the club more stable and forgiving.

Through the use of explosion welding, the club designer is free to use a greater variety of materials than previously available. This allows the club designer to manipulate the feel and mechanical aspects of the golf club, and also to choose materials to obtain a desired acoustical response of the club head during use. The sound created by the club head striking a golf ball is an important aspect for golf clubs, particularly golf clubs that have a hollow (or foam filled) region, such as hybrid- and wood-type club heads.

Furthermore, by choosing a robust material as one of the face layers 121, 122, the face 120 can be made thinner, freeing more weight and mass for relocation to more desirable locations within the club head, while still exhibiting adequate resistance to the forces generated during normal use of the resulting golf club. Using a thinner face can increase the club head coefficient of restitution (COR). COR is an important characteristic of golf clubs, especially hybrid- and wood-type golf clubs. COR is a measure of the efficiency of the transfer of energy between two colliding bodies, in this case the golf club and the golf ball. As the efficiency of the energy transfer increases, the COR, the initial ball velocity, and the ball travel distance increase. By using a thinner club face, the amount of club face deformation increases, as do the club head COR and the forces imparted to the ball.

Referring again to FIG. 10, Table 5 below provides exemplary values for dimensions $a_1$, which is a measure of the thickness of the outer layer 121, $b_1$, which is the thickness of the inner layer 122 in the attachment region thereof, and $b_2$, which is the thickness of the inner layer 122 in a central region thereof (if different than $b_1$). Each of the exemplary faces 120 were attached to a body 10 formed of 431 stainless steel.

TABLE 5

| Outer Layer | Inner Layer | $a_1$ (mm) | $b_1$ (mm) | $b_2$ (mm) |
|---|---|---|---|---|
| Ti 6-4 | SS 431 | 2.5 | 2.5 | — |
| Ti 6-4 | SS 431 | 2.0 | 3.0 | — |
| Ti 6-4 | SS 431 | 2.0 | 2.5 | 1 |
| Ti 6-4 | SS 431 | 2.5 | 3 | — |

Figure 11:
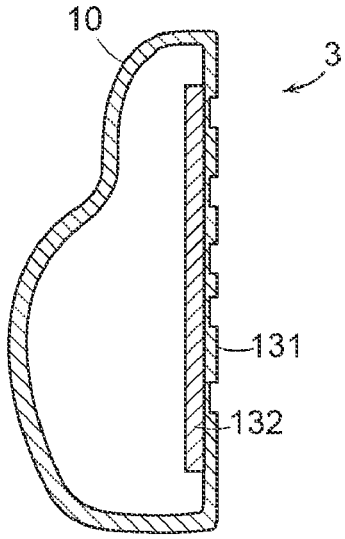
FIG. 11 shows a cross-sectional view through a golf club head of the present invention.

FIG. 11 shows a cross-sectional view through a golf club head 3 of the present invention. This golf club head 3 is similar to the previously discussed club head 2, but differs in that the outer layer 131 is formed of material, such as a stainless steel alloy, that is similar to the material forming the club head body 10. An inner layer 132 is provided, and is coupled to the outer layer 131 via explosion welding. The inner layer 132 functions as a back plate, providing support to the striking face. A preferred material for the inner layer 132 is a titanium alloy. Inclusion of the back plate 132 allows the outer layer 131 to be made very thin (for example, less than 0.11 inch thick), and the overall thickness of the bi-material face (the combination of outer layer 131 and inner layer 132)

may also be made relatively thin, providing enhanced weight and mass benefits as discussed above.

Figure 12:
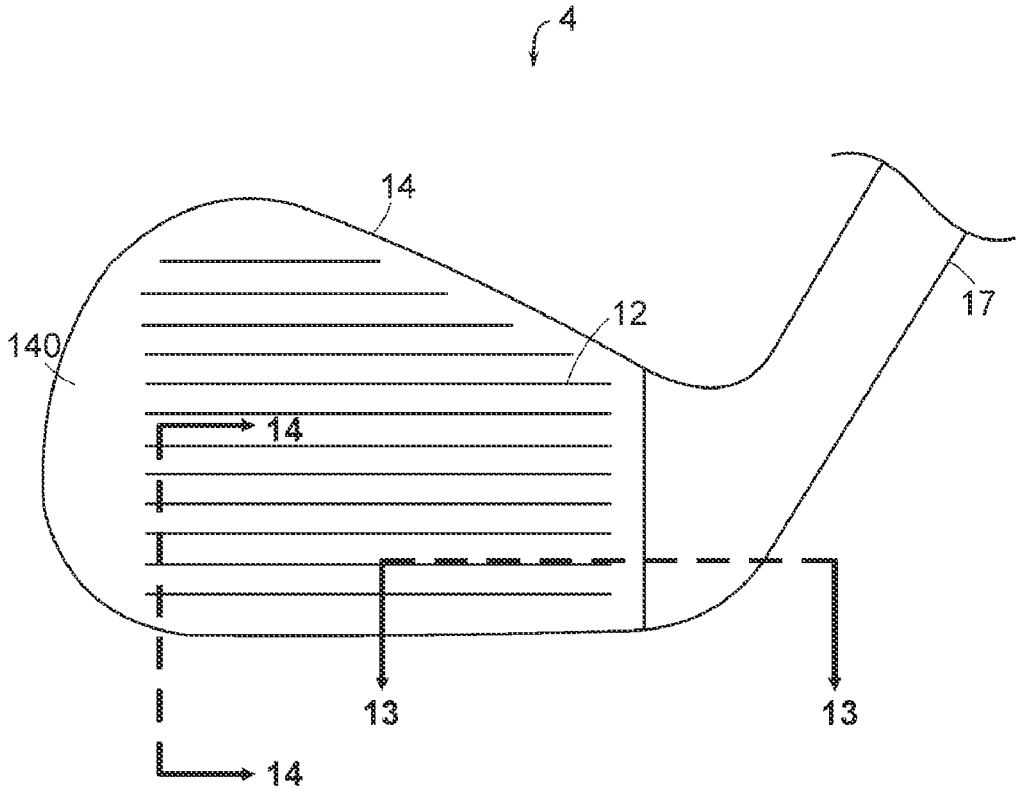
FIG. 12 shows a front view of a golf club head of the present invention.

FIG. 12 shows a front view of a golf club head 4 of the present invention, which in this illustration takes the form of a wedge. The face 140 includes a durable outer layer 141 coupled to a soft inner layer 142 via explosion welding. Preferably, the outer layer 141 has a hardness of approximately 30 Rockwell C or greater, more preferably 45 Rockwell C or greater, and the inner layer 142 has a hardness of approximately 25 Rockwell C or less. The durable outer layer 141 ensures that the impact surface, including the grooves 12, are wear resistant. Inclusion of a soft material behind an impact surface formed of a durable material helps ensure that the club maintains the desired feel and acoustic response. The soft inner layer 142 also allows the club head body 10 to be formed of a material that allows for customization via bending and grinding.

Figure 13:
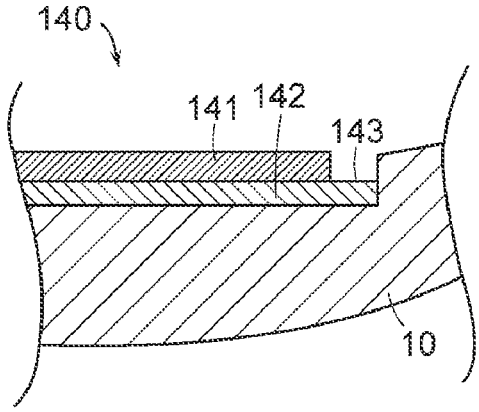
FIG. 13 shows a partial cross-sectional view taken along line 13-13 of FIG. 12.

FIG. 13 shows a partial cross-sectional view of the club head 4 taken along line 13-13 of FIG. 12, and illustrates one method of coupling the face 140 to the body 10. In the illustrated embodiment, the perimeter of the outer layer 141 does not extend to the perimeter of the inner layer 142, resulting in a gap 143 when the face 140 is positioned relative the body 10. The gap 143 may be created by machining the perimeter of the face 140 to remove the material of the outer layer 140 along the peripheral edge of the face 140. Because the inner layer 142 and the body 10 are formed of complimentary materials, they may be coupled together by welding. The gap 143 provides a volume in which the weld bead may be located. Additionally, a vibration damping material may also or alternatively be positioned within the gap 143.

A preferred hardness range for the outer layer 141 is approximately 20 Rockwell C to approximately 100 Rockwell C, and a preferred hardness range for the inner layer 142 is approximately 50 Rockwell B to approximately 100 Rockwell B. Exemplary preferred materials for the inner layer 142 and the body 10 include soft carbon steels (such as 8620, 1020, and 1030) and soft stainless steels (such as 410, 303, and 304). The inner layer 142 and the body 10 may be formed of the same material, or different (but weldable) materials.

Figure 14:
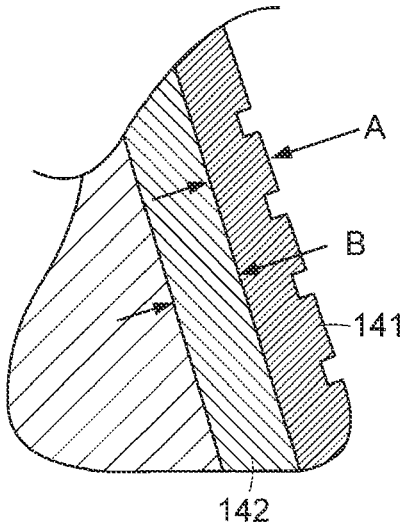
FIG. 14 shows a partial cross-sectional view taken along line 14-14 of FIG. 12.

FIG. 14 shows a partial cross-sectional view of the club head 4 taken along line 14-14 of FIG. 12, and Table 6 below provides exemplary values for dimensions A, which is the thickness of the outer layer 141, and B, which is the thickness of the inner layer 142.

TABLE 6

| Outer Layer | A (mm) | Inner Layer | B (mm) | Body |
|---|---|---|---|---|
| Ti 6-4, HRc 40 | 1 | SSt 410, HRb 80 | 2 | SSt 410 |
| Ti 6-4, HRc 40 | 1 | SSt 303, HRb 75 | 4 | SSt 410 |
| Ti 6-4, HRc 40 | 2 | CuNi, HRb 50 | 2 | SSt 410 |
| SSt 1770, HRc 45 | 2 | SSt 303, HRb 75 | 2 | SSt 329 |

Figure 15:
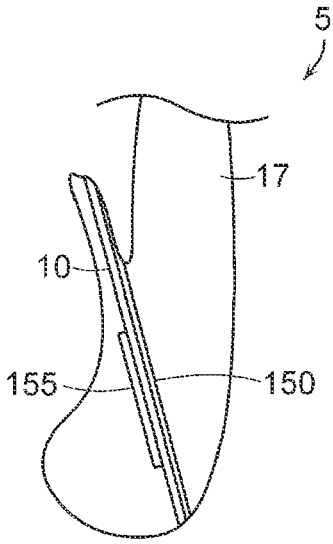
FIG. 15 shows a partial cross-sectional view of a golf club head of the present invention.

FIG. 15 shows a partial cross-sectional view of a golf club head 5 of the present invention. Club head 5 is similar to the other club heads discussed above, but further includes a pocket or void 155 formed in the club head body 10 behind the face 150. The pocket 155 may be created during the casting (or other manufacturing process) of the body 10, or may be created by machining the body 10 after it has been formed. The pocket 155 may be left empty, or a vibration damping material may be positioned therein prior to coupling the face 150 to the body 10. Exemplary damping materials include rubber, urethane, and lead.

The golf club heads of the present invention may be manufactured according to a variety of methods. One exemplary method includes coupling dissimilar materials via explosion welding as discussed above. From the resulting multi-material sheet, a face blank is cut or punched. Additional manufacturing steps can be applied to the blank, such as creation of the gap 143 discussed above. The face can then be coupled to a body, which is formed in known fashion, such as by welding the softer face material to the body. Once in place, the face can then be machined to form grooves and, optionally, surface roughened as discussed above.

As stated above, the grooves are provided on the face to assist in imparting spin to the ball. Under ideal conditions, there are no secondary elements present between the striking face and the golf ball. In reality, however, secondary elements such as grass, dirt, sand, and water, are often present during use. These elements may adversely effect the ability of the grooves to grip and impart spin to the ball. To minimize these effects, the present invention provides groove geometries that provide better channeling of grass, dirt, sand, water, and other debris away from the point of impact. These groove geometries may also provide greater traction between the club head and golf ball.

Figure 19:
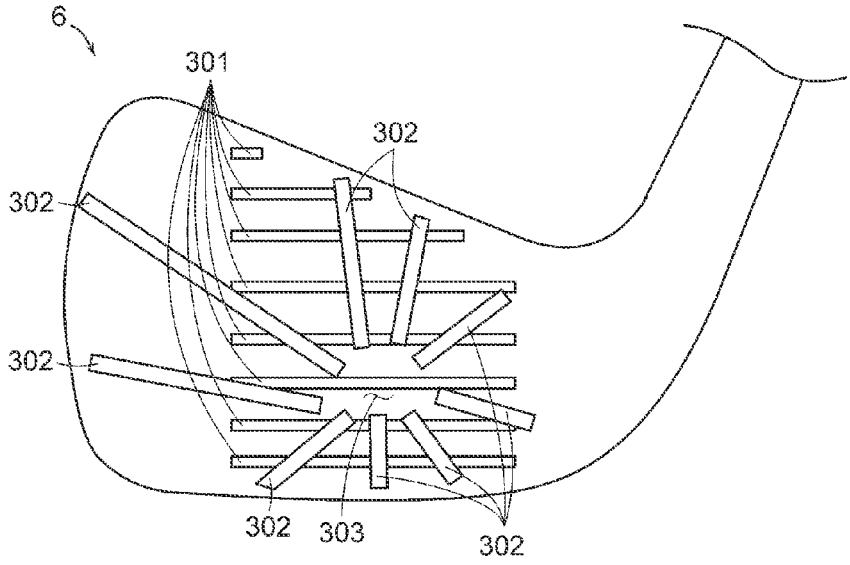
FIG. 19 shows a groove geometry for a golf club head of the present invention.

FIG. 19 shows a groove geometry of a golf club head 6 of the present invention. The strike face includes two sets of grooves. A first set of grooves 301 contains grooves oriented in a traditional groove pattern. The strike face also includes a second set of grooves 302. In the illustrated embodiment of FIG. 19, the second set of grooves 302 is centered around the club head sweet spot 303, the portion of the strike face most intended to contact the golf ball during use. The grooves 302 are arranged in a starburst pattern around the area 303 of intended impact, providing channels at a plurality of angles for debris to escape and be removed away from the impact area 303. The impact area 303 around which the grooves 302 are centered may be, for example, approximately 0.4 to 0.8 inch above the leading edge of the club head 6, as a function of dynamic loft.

Figure 20:
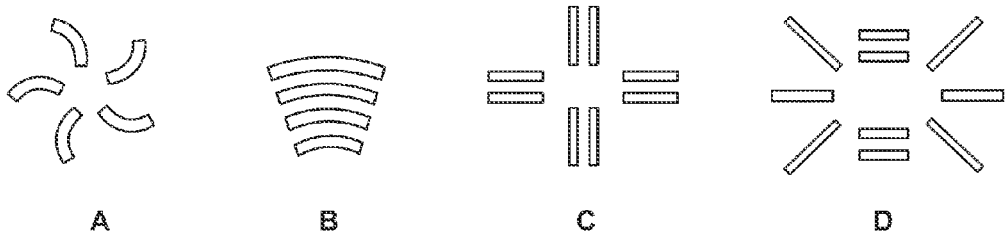
FIGS. 20A-D show groove geometries for a golf club head of the present invention.

FIGS. 20A-D show alternate geometries for a second set of grooves 302 of a golf club head of the present invention. FIG. 20A shows a plurality of arced grooves arranged in a swirl pattern. FIG. 20B shows a plurality of arced grooves arranged substantially concentrically. Rather than being concentric, the grooves of FIG. 20B could also be arranged in a parallel manner. That is, each groove could be substantially identical to the other grooves, having the same length and curvature, but being translated upward or downward. FIG. 20C shows a pattern including both horizontal and vertical grooves. FIG. 20D shows a pattern including horizontal and angled grooves. It should be noted that the exemplary groove geometries herein described are illustrative in nature. Different orientations and different numbers of grooves can also be used. Similarly, the grooves 302 are referred to herein as a "second" set for purposes of illustration and distinction. These grooves 302 can be used alone or in conjunction with a standard set of grooves 301, and may be used with any type of golf club. While the club designer may choose a variety of widths and depths for these grooves 302, in one embodiment these grooves 302 may not be as deep as the first set of grooves 301. The grooves 301, 302 may be created by machining (such as milling), chemical milling, laser etching, stamp/forge rolling, water etching, or by other manufacturing processes.

Figure 21:
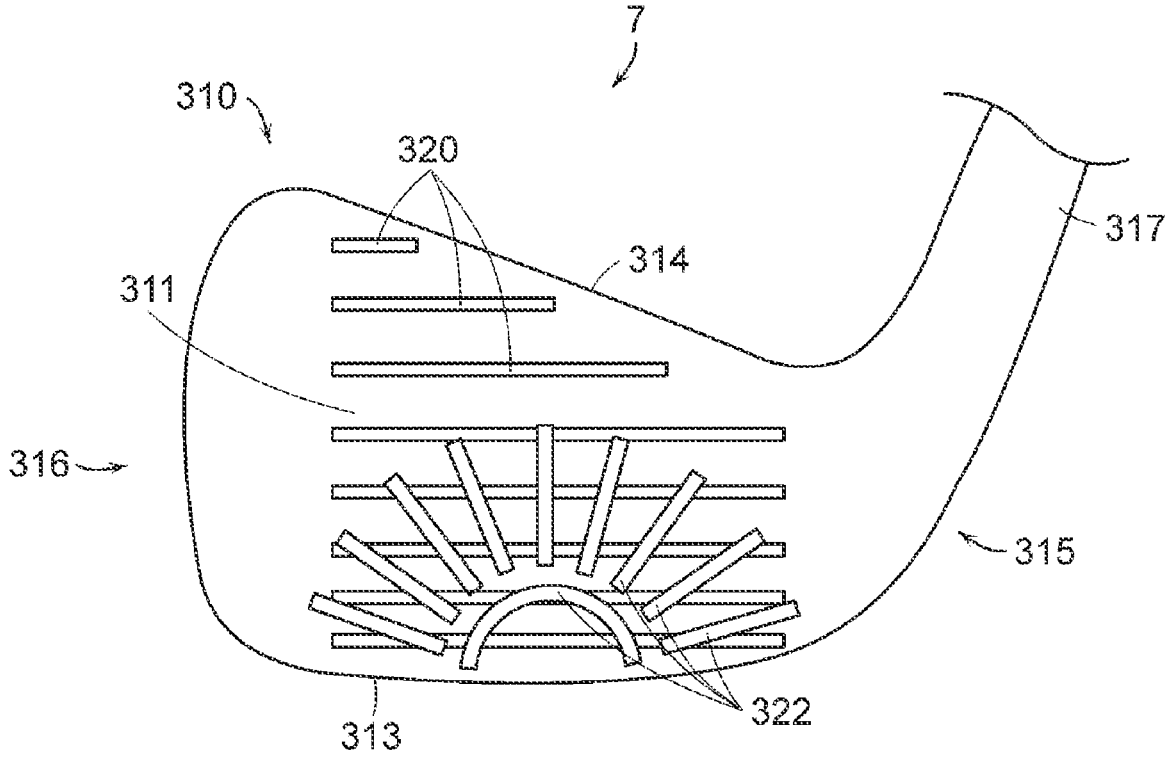
FIG. 21 shows a groove geometry for a golf club head of the present invention.

FIG. 21 shows another groove geometry of a golf club head 7 of the present invention. Club head 7 includes a body 310 that defines a strike face 311, a sole 313, a top line 314, a heel 315, a toe 316 and a hosel 317. Strike face 311 may be unitary with body 310, or it may be a separate component, such as a strike face insert, coupled to body 310.

Strike face 311 includes two sets of grooves that extend into strike face 311 from a striking surface thereof. A first set of grooves 320 contains grooves oriented in a traditional groove pattern. The strike face also includes a second set of grooves 322. The second set of grooves 322 is generally centered in the lower central portion of the strike face of club head 7 and is also generally arranged in a starburst pattern. Grooves 320, 322 may be created by machining (such as milling), chemical milling, laser etching, stamp/forge rolling, water etching, or by other manufacturing processes.

Similar to the previously described embodiments, the width and depth of the grooves may be selected to have any desired dimensions. For example, either or both sets of grooves 320, 322 may have a depth that is greater than or less than a finish layer material included on club head 7. In an embodiment, club head 7 includes a finish layer that is corrosion resistant and the second set of grooves 312 has a depth that is greater than the thickness of the finish layer. The second set of grooves 312 may be created after the application of the finish layer so that the second set of grooves 312 extends through the finish layer or the second set may be created before and masked during application of the finish layer. As a result, the base material of club head 7 is exposed while the remainder is protected from corrosion and wear by the finish layer. Because the second set of grooves 312 extends through the finish layer, a raw portion of club head 7 is allowed to corrode, such as by rusting if the base material is a carbon steel, in the pattern of the second set of grooves 312. The corrosion of a portion that is left raw provides a portion of club head 7 having at least the appearance of increased surface roughness. A club head having such grooves may be exposed to accelerated aging as a step in the manufacturing process to accelerate the corrosion of the raw portion of the club head. The first set of grooves 310 may also have a depth that is greater than the thickness of the finish layer but grooves 310 are created prior to application of the finish layer so that grooves 310 do not extend through the finish layer and are protected from wear and corrosion by the finish layer.

It should be appreciated that the groove geometry may have any desired shape and size on the club head, such as any of the embodiments previously described. For example, the groove geometry may have multiple sets of the grooves and each of the sets may have a different shape. The shapes may include logos or other custom marks. Additionally the groove geometry may also include one or more patterns, such as a grid or an array of dots, in addition to or as an alternative to one or more of the sets of grooves. The groove geometry provides visual feedback for the alignment of the club head during each shot and gives the appearance of increased strike face roughness.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents. Furthermore, while certain advantages of the invention have been described herein, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein. Additionally, while certain advantages have been described above with respect to a particular type of golf club head, such as an iron-type club head or a hybrid-type club head, the disclosed advantages are not dependent upon the particular type of club head used above for illustrative purposes to describe such advantages.

I claim:

1. A golf club head, comprising:

a body comprising a striking face that defines a striking surface, wherein the striking face comprises a first set of grooves having a first pattern and a second set of grooves having a second pattern different than the first pattern, wherein the first set of grooves and the second set of grooves extend into the striking face from the striking surface, wherein the first set of grooves and the second set of grooves at least partially overlap, wherein the grooves of the second set of grooves are generally concentric about, and spaced from, a center that is located in the lower central portion of the striking face between about 0.4 inch and about 0.8 inch above the leading edge of the club head, and wherein the first set of grooves overlaps the center.

2. The golf club head of claim 1, wherein the first set of grooves includes a plurality of parallel grooves and the second set of grooves includes a plurality of grooves, each oriented at an angle relative to the first set of grooves.

3. The golf club head of claim 2, wherein the second set of grooves are arranged in a starburst pattern.

4. The golf club head of claim 1, wherein the second set of grooves includes a plurality of arced grooves.

5. The golf club head of claim 4, wherein the second set of grooves is arranged in a swirl pattern.

6. The golf club head of claim 1, wherein the striking face is a striking face insert that is attached to the body.

7. A golf club head, comprising:

a body; and a striking face insert attached to the body and defining a striking surface, wherein the striking face insert comprises a first set of grooves having a first pattern including a plurality of parallel grooves and a second set of grooves having a second pattern different than the first pattern and at least partially overlapping the first set of grooves, wherein the first set of grooves and the second set of grooves extend into the striking face from the striking surface, wherein the depth of the second set of grooves is less than the depth of the first set of grooves, wherein the grooves of the second set of grooves are generally concentric about, and spaced from, a center that is located in the lower central portion of the striking face insert between about 0.4 inch and about 0.8 inch above the leading edge of the club head, and wherein the first set of grooves overlaps the center.

8. The golf club head of claim 7, wherein the second set of grooves includes a plurality of grooves, each oriented at an angle relative to the first set of grooves.

9. The golf club head of claim 8, wherein the second set of grooves are arranged in a starburst pattern.

10. The golf club head of claim 7, wherein the second set of grooves includes a plurality of arced grooves.

11. The golf club head of claim 10, wherein the second set of grooves is arranged in a swirl pattern.

* * * * *